United States Patent [19]

Bartels

[11] 3,933,053

[45] Jan. 20, 1976

[54] DITCHER

[75] Inventor: Fred Willie Bartels, Edmonton, Canada

[73] Assignee: Banister Pipelines Ltd., Edmonston, Canada

[22] Filed: Aug. 23, 1974

[21] Appl. No.: 500,089

Related U.S. Application Data

[62] Division of Ser. No. 343,107, March 20, 1973, Pat. No. 3,863,988.

[52] U.S. Cl. ..... 74/243 R; 74/243 C; 74/243 DR; 74/413; 74/448

[51] Int. Cl.². F16H 55/30; F16H 1/06; F16H 55/12

[58] Field of Search ..... 74/448, 447, 446, 439, 74/413, 243 DR, 243 C, 243 R

[56] References Cited

UNITED STATES PATENTS

| | | | |
|---|---|---|---|
| 869,058 | 10/1907 | Callan | 74/243 R |
| 1,773,288 | 8/1930 | Valletta | 74/413 |
| 3,220,273 | 11/1965 | Christian | 74/448 X |

FOREIGN PATENTS OR APPLICATIONS

| | | | |
|---|---|---|---|
| 743,651 | 4/1933 | France | 74/243 C |

*Primary Examiner*—Leonard H. Gerin
*Attorney, Agent, or Firm*—Millen, Raptes & White

[57] ABSTRACT

A multi-phase drive system is provided in a ditcher having a non-axially supported digging wheel comprising spaced rim assemblies. Each rim assembly carries a double segment of teeth. A pair of double sprockets drive each rim assembly. The land of each double sprocket functions as a bearing to support the digging wheel. The drive systems for the rim assemblies are interconnected by a common shaft. The system functions to drive an unusually large and heavy digging wheel.

4 Claims, 15 Drawing Figures

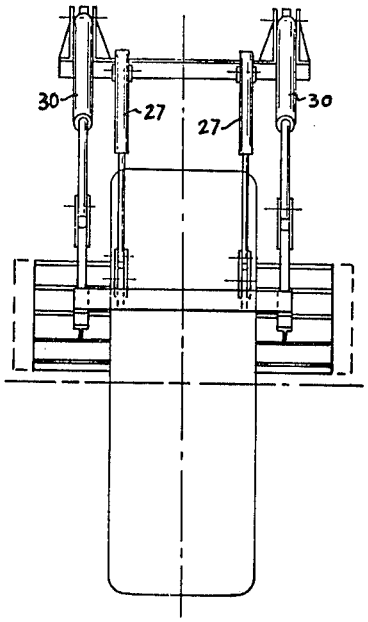
Fig. 4.
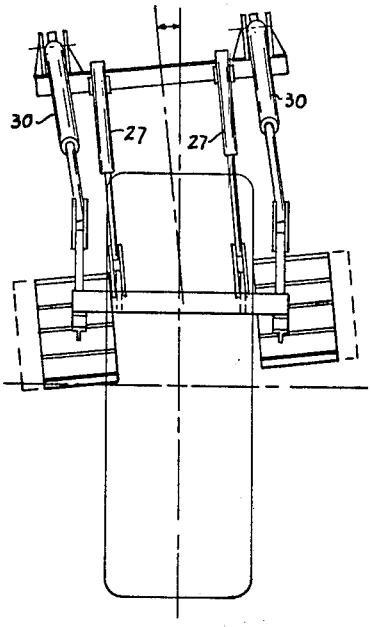
Fig. 5.
Fig. 6.
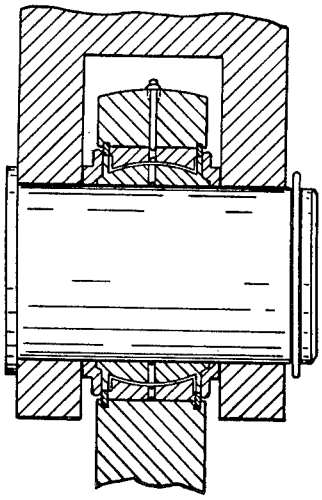

DITCHER

This is a division of application Ser. No. 343,107, filed Mar. 20, 1973, now U.S. Pat. No. 3,863,988.

BACKGROUND OF THE INVENTION

This invention relates to a ditcher of the type used to excavate pipeline trenches and the like.

A conventional ditcher generally comprises a carrier, usually a crawler tractor, carrying a rotatable digging wheel at its rear. More particularly, the carrier supports an upstanding, rigid suspension frame. This suspension frame includes one or two substantially vertical beams at its rear end. Each vertical beam carries a slide guide. The digging wheel is held in a rigid wheel frame, which is generally rectangular in shape and extends around the wheel. The front end of this wheel frame is pivotally attached to a slide member. In turn, the slide member is mounted on the beam slide guide and can slide up and down thereon to alter the elevation of the wheel. A substantially vertical hydraulic cylinder is suspended from the upper end of the suspension frame and attached at its lower end to the slide member. Contraction and expansion of this cylinder moves the wheel frame between the elevated travelling position and the lowered digging position. A cable is attached to the rear end of the wheel frame. It extends over a sheave, carried by the suspension frame, to a drum on the carrier. This cable functions to suspend the wheel frame horizontally when the ditcher is digging a trench. It also serves to rotate the wheel frame upwardly, about its front pivot connection, to the elevated travelling position. The tractor is equipped with a motor, and suitable hydraulic systems and drives for operating the digging wheel and actuating the lifting cylinders. It will be noted that the conventional ditcher in use today relies on the sheer weight of the digging wheel to obtain penetration into the soil — although it has been suggested by others that the cable may be replaced with a hydraulic cylinder to force the wheel down (see U.S. Pat. Nos. 3,226,856 and 3,510,970).

At the present time there is a need for a ditcher which can operate in the Arctic to excavate trenches for the laying of large-diameter pipelines. Existing ditchers are not suitable for this service, as will be recognized from the following discussion.

Many areas of the Arctic are covered with permafrost. This is a hard mixture of ice and organic material, such as peat. The permafrost may extend from a depth of several feet to several thousand feet. At its surface, the permafrost is frequently covered with a surface mat of vegetation, such as grass or lichen. This surface mat may vary in thickness from a few inches to a foot or more. In summer, the surface mat insulates the permafrost from the heat of the Arctic sun. If the surface mat is not present, the permafrost will, of course, melt in the summer. An example will serve to bring out the seriousness of this thermal erosion problem: A trench having a width and depth of one foot, and length of twenty feet was cut into the permafrost about five years ago. Today this trench has a width of about twenty feet, a length of several hundred yards, and a depth of approximately fifty feet.

In pipeline practice, it is necessary to excavate a trench having a level bottom. Otherwise the pipe will lie against the wall of the trench, which is undesirable. It is therefore conventional to precede the ditcher with a bulldozer which cuts a level right-of-way across side hills and the like. This practise is unacceptable for the Arctic, as the surface mat will be removed. It is possible to replace a strip of mat having a width of a few feet with wood chips — however it is important to do this across a width of approximately twenty feet. In any case, the permafrost is so hard that a bulldozer cannot shave it down in a reasonable period of time.

With the foregoing comments in mind, it is one object of this invention to provide a ditcher having the combined capabilities of being able to: (1) force the digging wheel into the hard permafrost and hold it there while trenching; and (2) tilt the digging wheel, when the ditcher is operating on a side hill, so that the trench walls are always vertical and its bottom is horizontal.

As described below, hydraulic cylinders or their mechanical equivalents are preferably used in this invention to hold the wheel frame and its associated wheel in place so that this wheel assembly cannot ride up out of the trench when operating in hard permafrost. There is a liklihood that the wheel will periodically encounter particularly hard material when digging and, if rigidly connected to the hold down cylinder, it will exert excessive forces on the cylinder, eventually damaging it. In addition, in passing over bumps in the hard terrain, vertical misalignment will occur between the carrier and the digging wheel assembly, thereby also creating a strain on the hold down cylinder.

It is therefore another object of this invention to provide a limited amount of "play" or float capability at the connection between the hold down cylinder and the wheel frame so that, while the cylinder does constrain the wheel frame substantially in the digging position, a limited range of movement of the wheel frame about its pivot connection with the suspending frame is still permitted. This "play" serves another function, as explained below, in that it makes it possible to tilt the wheel frame.

The Arctic ditcher is required to excavate a uniquely large trench through extremely hard material. With this in mind, it is another object of the invention to provide a ditcher which is powered by twin engines — one of which drives the digging wheel only while the other engine drives the remaining hydraulic components. In this manner, the power available to the digging wheel is not diminished due to periodic heavy load conditions affecting other parts of the machine.

The ditcher is called on to operate under extremely severe weather conditions. Temperatures below -60°F are not uncommon. Under these conditions, the frequency of mechanical breakdown is enormously increased. It is therefore another object of this invention to incorporate an emergency cross-over system into the hydraulic circuitry of the machine so that, in the event that one engine breaks down, the other engine can take over sufficient functions to enable the ditcher to lift its wheel, move off the right of way, and return to the base camp for repair, or continue operating at a reduced production rate.

It is another object of the invention to provide a ditcher having an engine — hydraulic circuit system which can be warmed up without load on starting the machine.

The carrier's tracks must be capable of bracketing the wide trench which is excavated — yet the carrier should still be capable of being loaded on a conventional truck bed. It is therefore another object of the invention to provide a carrier having tracks which can be spread apart or brought together, even when the machine is standing on the ground.

It is another object of the invention to provide a ditcher having a digging wheel drive which is designed to reduce the high-stress input between the sprocket and wheel segment teeth, thereby reducing the liklihood of failure at low temperatures due to brittleness of the metal.

It is another object to provide a ditcher having a braking system to enable it to operate successfully on down-hill terrain.

It is another object of the invention to provide the digging wheel buckets with teeth whose digging angle is substantially greater than that of the conventional ditchers, thereby improving the excavating rate to a surprising extent.

SUMMARY OF THE INVENTION

In accordance with one aspect of the invention, a ditcher is provided having the dual capabilities of being able to exert a hold down force on the wheel frame and to tilt the wheel frame relative to the plane of the main frame of the carrier. These capabilities make if possible for the ditcher to trench in hard material and to excavate a vertical trench when moving across a side hill.

According to the preferred form of the invention, a pair of spaced, parallel, independently operable lifting cylinders are suspended at their upper ends from the rear upper section of the suspension frame. At their lower ends, these cylinders are connected by spherical bearing couplings to the front end of the wheel frame. A pair of spaced, parallel hold down cylinders are connected at their front ends by spherical bearing couplings to the rear upper section of the suspension frame. At their rear ends, the hold down cylinders are connected by spherical bearing couplings to slide structures, of limited length, each slide structure being associated with one side of the wheel frame. Preferably these slide structures each comprise a pin, attached to the cylinder end, transversely disposed in a short slot formed in the wheel frame. Each slot extends lonitudinally substantially parallel to the longitudinal axis of the wheel frame. It will be seen, therefore, that there is a solid connection between each hold down cylinder and the wheel frame when the pin is at either end of the slot; yet there is a bulit-in float capability in that the pins can slide back and forth within the short slots. In operation, the wheel frame can be lifted or lowered by expanding or contracting the two sets of cylinders. To tilt the wheel frame, the lifting cylinders are actuated to make them uneven in length. The spherical bearing couplings enable the joints affected by tilting of the wheel frame to accomodate the movement. The slots enable the tilting movement to take place, even though the lengths of the hold down cylinders are not adjusted. In other words, as tilting takes place, there would be a jamming effect if the equally long hold down cylinders were rigidly attached to the wheel frame. The slots or slide solve this difficulty by permitting limited relative movement between the wheel frame and the hold down cylinders. The slots also function to accomodate minor vertical misalignments between the carrier and the wheel assembly, as will occur when the machine is passing over undulating terrain. The hold down cylinders can be engaged to restrain the wheel frame from rotating about its pivot connection with the suspension frame and can be actuated to press the wheel assembly into the ground.

Broadly stated, the invention is an improvement on a ditcher comprising a carrier, having a main frame and an upstanding suspension frame secured to said main frame, and a rigid wheel frame, supporting a rotatable ditching wheel, pivotally connected at its front end to the suspension frame and movable thereon between a lowered position and an elevated position. The improvement comprises the combination of: means, connecting the wheel frame and suspension frame, for raising and lowering the wheel frame along the suspension frame; means, associated with the wheel frame and suspension frame, for tilting the wheel frame relative to the plane of the main frame; and means, associated with the wheel frame and suspension frame, adapted to be engaged to constrain the wheel frame from rotating about its pivot connection with the suspension frame; and means, associated with the wheel frame and suspension frame, adapted to rotate the wheel frame downwardly about its pivot connection with the suspension frame to force the ditching wheel into the ground.

DESCRIPTION OF THE DRAWINGS

FIG. 4 is a rear elevation showing the hoisting-tilting assembly mounted on the carrier.

FIG. 5 is a view similar to that of FIG. 4, showing the carrier in a side-hill position, with the assembly in the tilted position.

FIG. 6 is a front view, in section, of the spherical bearing used in conjunction with the ditcher.

DESCRIPTION OF THE PREFERRED EMBODIMENT

Figure 1:
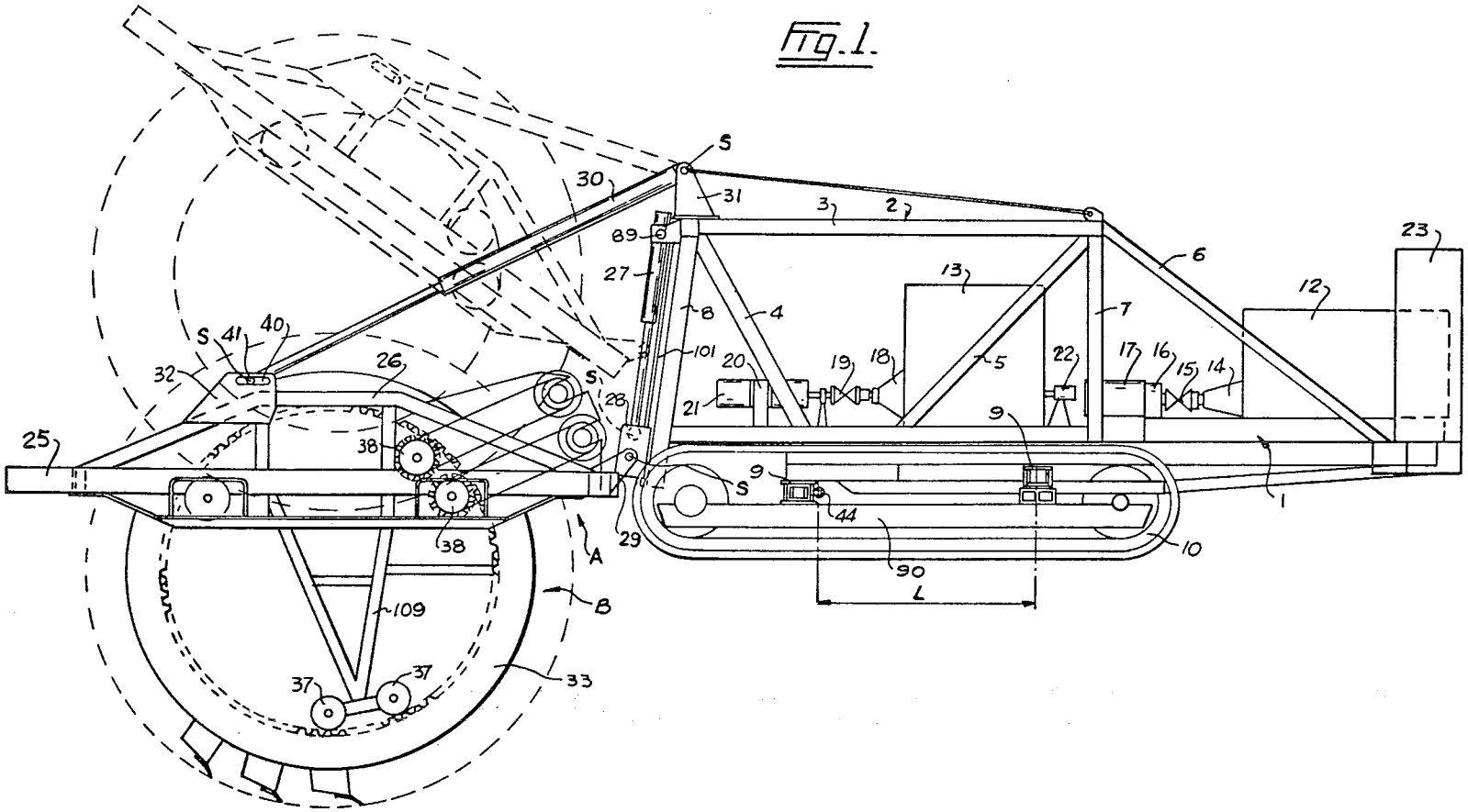
FIG. 1 is a general arrangement side elevation view of the ditcher depicting both the twin-engine power system and the wheel assembly shown in the digging position and in the transport position in phantom lines.

In general, the ditcher comprises a carrier A having a wheel assembly B suspended therefrom. The carrier A has a horizontal main frame 1 to which is rigidly secured an upstanding suspension frame 2. The main frame 1 includes the track assembly C shown in FIG.

11. This track assembly C comprises extendable transverse members 9, and longitudinally extending track frames 90, which support the track system. Hydraulic cylinders 44 are provided to extend and retract the track frames 90. Front and rear engines 12, 13 are mounted on the main frame 1 and drive the various hydraulic circuits described in detail below. A reservoir tank 23 supplies hydraulic fluid to the circuits. The wheel assembly B comprises a wheel frame 25. This wheel frame 25 carries a sub-frame 109, equipped with rollers 37, and sprocket wheels 38. The digging wheel 33 is rotatably mounted on the rollers 37 and sprocket wheels 38. At its front end, the wheel frame 25 is pivotally attached to slide members 28. These slide members 28 move along slide rails 101 carried by the rear beams 8 of the suspension frame 2. Lifter cylinders 27 connect the suspension frame with the wheel frame 25 and function to raise and lower the latter. Hold down cylinders 30 connect the upper section of the suspension frame 2 with the rear end of the wheel frame 25 — they function to force the digging wheel into the ground and hold it in place.

The hoisting-tilting assembly

Figure 15:
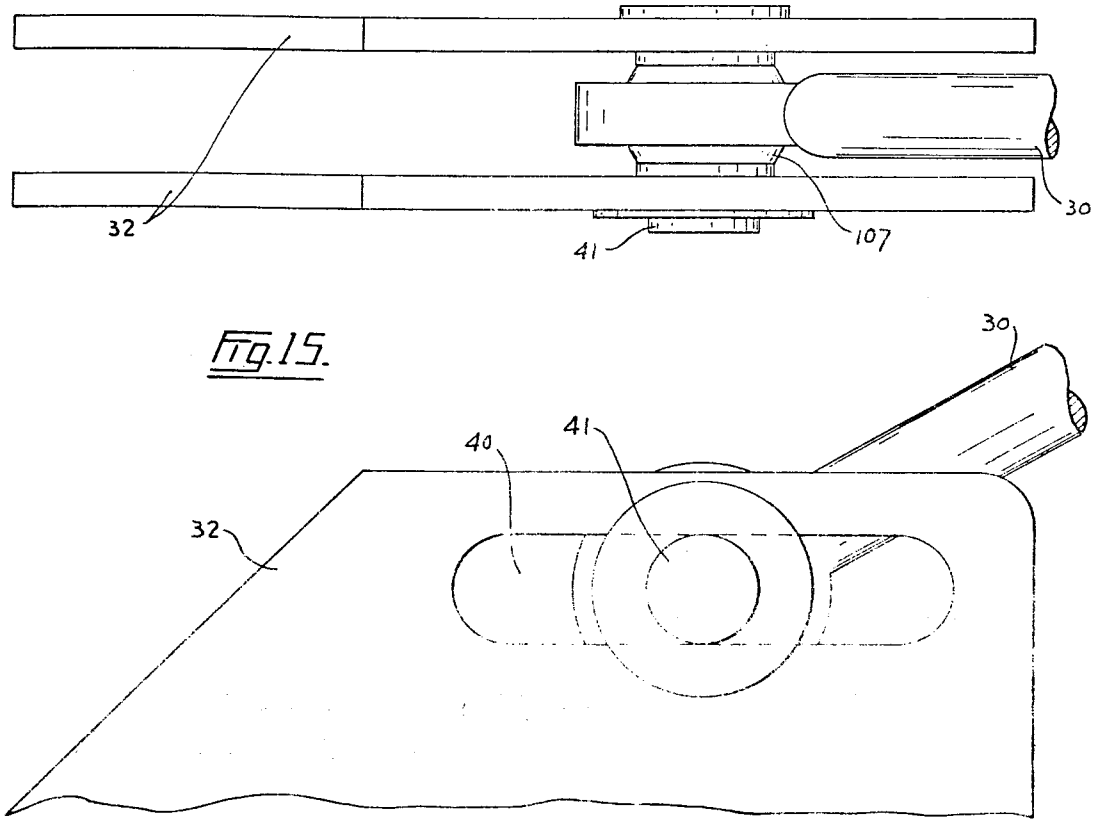
FIG. 15 combines top and side elevations showing the spherical bearing connection of the hold down cylinder with the slot member.

This assembly is shown isolated in FIG. 15 and appears in FIGS. 1, 4, 5, 9 and 10. It includes the upstanding suspension frame 2 which, in the embodiment shown, is rigidly secured to the main frame 1. The frame 2 includes a pair of substantially vertical, parallel, spaced slide beams 8. Each beam 8 includes an integral slide rail 101 positioned on its rear face. A horizontal cross bar 102 connects the slide beams 8 at their upper ends. The truss members 3, 4, 5, 6, 7 complete the structure. Functionally, the frame 2 provides an upward extension, of the carrier A, from which the wheel assembly B is suspended and on which it can slide between digging and travelling positions.

A pair of spaced, parallel lifting cylinders 27 are attached at their upper ends by trunnion joints 89 to brackets 31, which form part of the upper rear portion of the suspension frame 2. The cylinders 27, as will be brought out in the description of the hydraulic system which follows below, are adapted to be independently linearly contracted or expanded between fully open and fully closed positions and locked at any position intermediate said positions.

The wheel frame 25 is pivotally connected at its front end to the suspension frame 2. This wheel frame 25 is generally rectangular in form, being comprised of slide beams 103 and cross beams 104, welded together to form a rigid unit. A pair of ears 29 extend forwardly from the front corners of the wheel frame 25. Each of these ears 29 is connected by first coupling means to the lower end of one of the lifting cylinders 27. The first coupling means comprises a slide member 28, a first spherical bearing means 105 connecting the ear 29 to the slide member 28, and a second spherical bearing means 106 connecting the slide member 28 to the cylinder 27. Each slide member 28 is connected to a slide rail 101 and is movable thereon.

As shown in FIG. 6, each spherical bearing means comprises a spherical bearing and the conventional attachment means.

A bracket member 32 is firmly attached to each side of the wheel frame's upper section 26. A slot 40, having end faces 106, is cut in each member 32. The slots 40 extend longitudinally substantially parallel to the longitudinal axis of the wheel frame 25.

A pair of spaced hold down cylinders 30 are attached at their rearward ends to the bracket members 31 by third coupling means. Each third coupling means comprises a pin member 41 and a fourth spherical bearing 107. Each pin member 41 extends into the adjacent pair of slots 40 and can slide back and forth within them. At their forward ends, the cylinders 30 are connected to the brackets 31 at the upper end of the suspension frame 2 by second coupling means, namely the third spherical bearing means 108.

From the foregoing it will be understood that the lifter cylinders and their connections provide means, connecting the wheel frame and suspension frame, for positively raising and lowering the wheel frame along the suspension frame. The operative lifter cylinders cooperate with the spherical bearing connections to provide means for tilting the wheel frame relative to the plane of the main frame. The operative hold down cylinders and their connections can be engaged or locked to provide means for constraining the wheel frame from rotating about its pivot connection with the suspension frame and can be further actuated to force the digging wheel into the ground.

The digging wheel 33 is rotatably supported by the wheel frame 25. More particularly, the wheel 33 is mounted on a plurality of rollers 37, carried by a subframe 109 attached to the wheel frame 25, and the drive sprockets 38 which are suitably journalled in the wheel frame 25.

In operation, with the digging wheel 33 in its raised position and with the ditcher either stationary or moving, the operator, actuates lifting cylinders 27 to extend together to lower the slide members 28 and thus to lower the forward end of the wheel frame 25. As the wheel 33 commences its digging action in the ground, the operator causes the hold down cylinders 30 to extend, thus lowering the rearward end of the wheel frame 25 relative to its forward end and allowing the digging wheel 33 to excavate deeper into the ground. As digging progresses, the operator lowers the wheel 33 to obtain the desired depth of trench by alternately operating cylinders 27 and 30. The independent operation of cylinders 27 and 30 enables the operator to move wheel frame 25 into a horizontal position, as depicted in FIG. 1. This permits the conveyor system 39 to operate efficiently, since if the ditcher was operated with the wheel frame 25, and thus the conveyor 39, at an angle to the horizontal, the excavated earth would tend to slide to one side or other of the conveyor as it was being removed.

The raising of the wheel assembly from the ground is a reverse of the above procedure, with cylinders 27 and 30 being operated independently or together to effect the lifting motion.

The positioning of the wheel in the vertical sense, and thusly the control of the digging depth, is accomplished by extending or retracting the cylinders 27, cylinders 30 being extended or retracted in turn to maintain the wheel frame 25 in a generally horizontal position.

The wheel frame locating elements facilitate the tilting of the wheel 33. The tilting of the wheel frame 25, and its digging wheel 33, is accomplished by the independent extension or retraction of one cylinder 27 relative to the other cylinder 27; thus the wheel frame 25 is given an angular displacement relative to the plane of the main frame 1.

The upper cylinders 30 are not actuated in the tilting procedure and cannot be actuated independently one relative to the other. Thus when the wheel frame 25 is tilted, the pin member 41 on the relatively higher side of frame 25 will slide rearwards in its slot 40; the pin member 41 on the relatively lower side of frame 25 will slide forwards in its slot 40. If pin members 41 engaged closely-fitting circular holes in bracket member 32, rather than slots, the tilting motion would only be possible with the independent operation of cylinders 30 relative one to the other as well as the existing independent operation of cylinders 27. This would eliminate the floating action which is provided by means of the slots. The advantages of the floating action are, as previously described:

1. To enable the angularity between the forward crawler section and the rearward wheel section to exist to a minor degree so that small undulations of the terrain are absorbed, thus providing a smooth-bottomed trench of constant depth.
2. To enable the wheel to rise slightly over nonditchable objects at the extreme lower area of the ditching depth.

The slots 40 allow the floating action with the wheel in its normal digging position or in any tilted digging position.

When the wheel frame 25 is being raised or lowered and is not supported directly by the ground, the pin members 41 slide to the extreme forward side of the slots 40 due to the action of gravity upon the wheel assembly B and therefore the hold down cylinders 30 directly support part of the weight of the wheel assembly B and enable the raising or lowering action to proceed.

When the wheel assembly B is in a digging position, the pin members 41 are positioned approximately halfway between the ends of the slots 40 to allow the floating action. In this position, the cylinders 30 exert a downward force through the pin members 51 on the wheel frame 25. Since the slots 40 are located rearwardly of the centre of the wheel 33, this downward force acts at a substantial leverage distance.

While a slot and sliding pin arrangement is shown, the invention is not to be limited to such a structure. Essentially, the slot 40 provides a short slide for the end of the hold down cylinder 30. The same end could be achieved, for example, by substituting a slide rail having stop faces at each end and attaching the cylinder end to the rail. Alternatively, one could incorporate a free float control valve in the hydraulic cicuit controlling the cylinders 30. This latter system will permit the wheel to "float", however it has a shortcoming in that in the float position the cylinders 30 will not maintain a positive hold down on the wheel frame.

Figure 7:
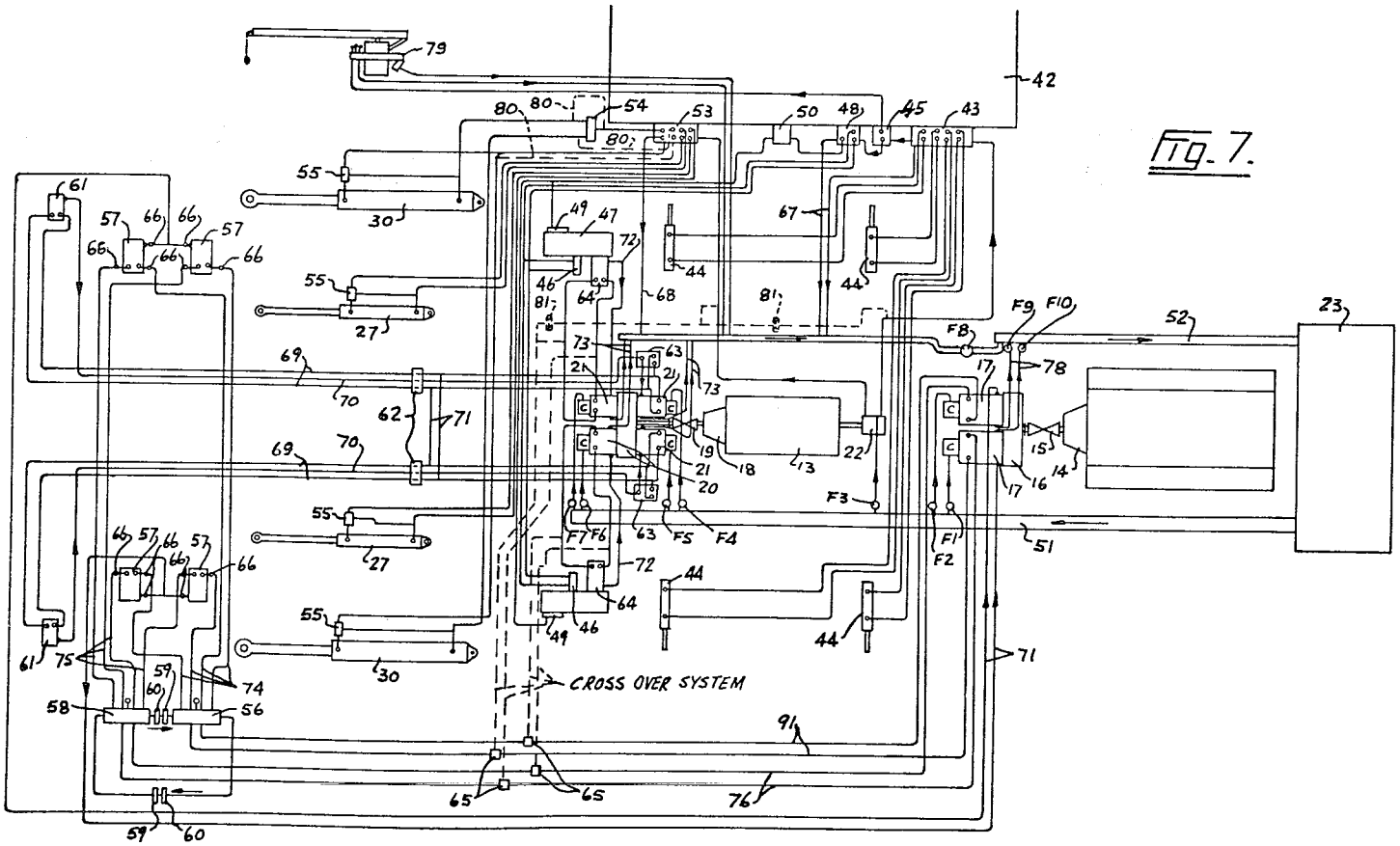
FIG. 7 is a schematic hydraulic circuit system of the ditcher.

Spherical bearings are provided at all points marked S (FIG. 7) to allow the simultaneous angular and rotational movement necessary for the raising, lowering and tilting of the wheel frame. The angular movement is depicted in FIG. 5 and the rotational movement is depicted in FIG. 7. It will be understood that, while spherical bearings are preferred for these connections, ball joints and other equivalents could also be used.

Track width adjust system

Figure 11:
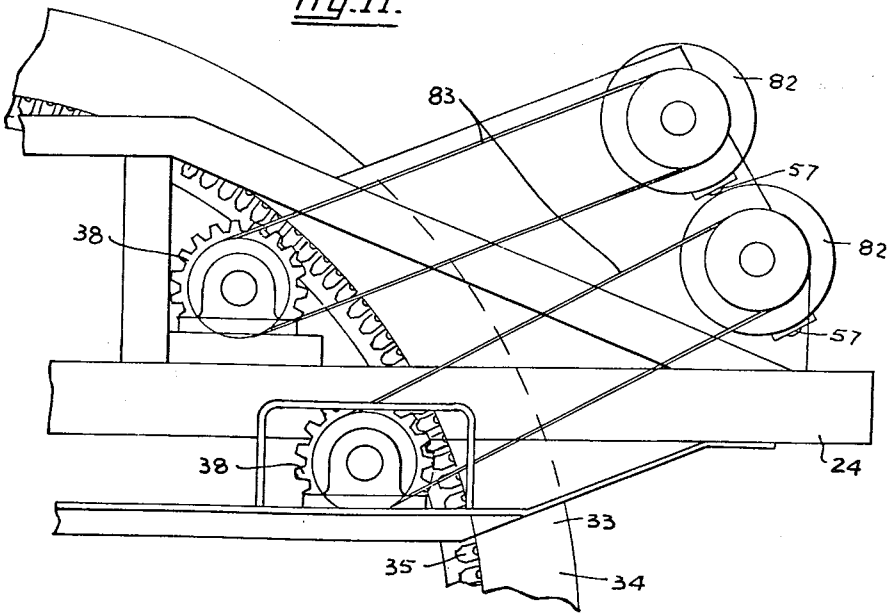
FIG. 11 is a side elevation, with parts broken away, depicting the drive sprocket wheels and the segment drive of the digging wheel.
Figure 13:
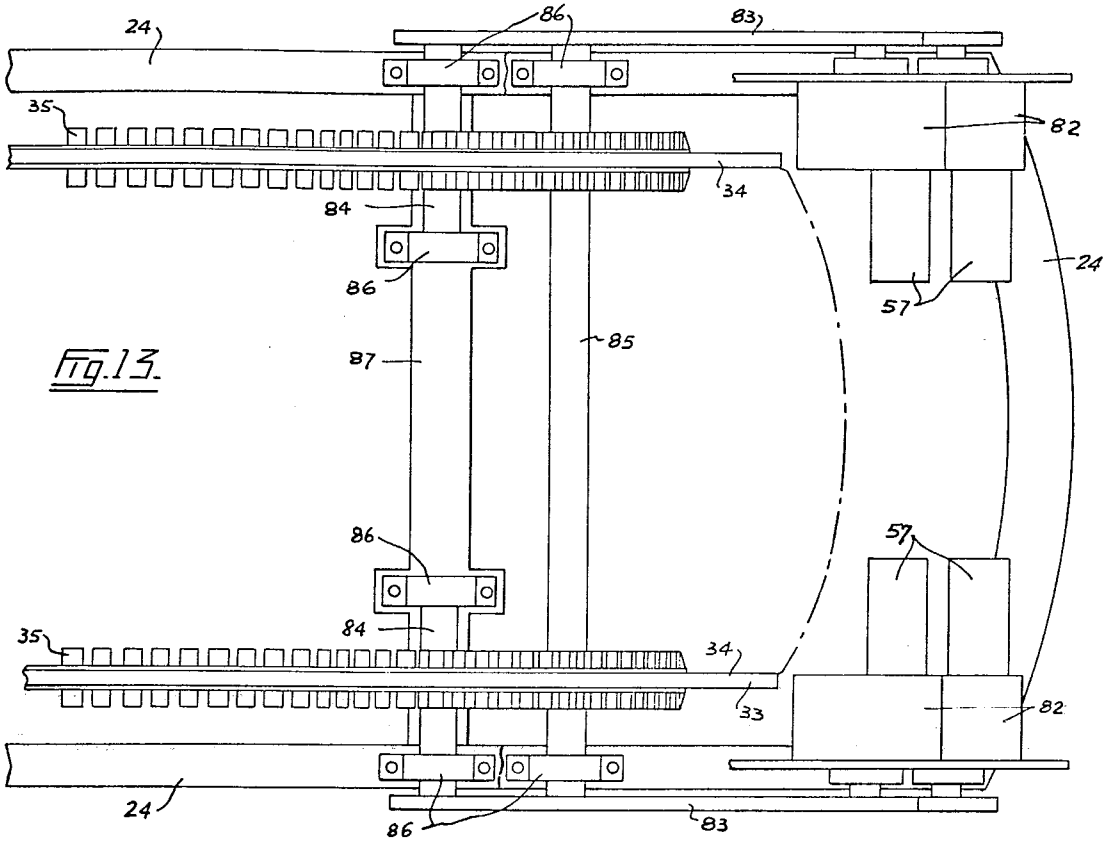
FIG. 13 is a top plan view, with parts broken away, of the wheel drive system.
Figure 14:
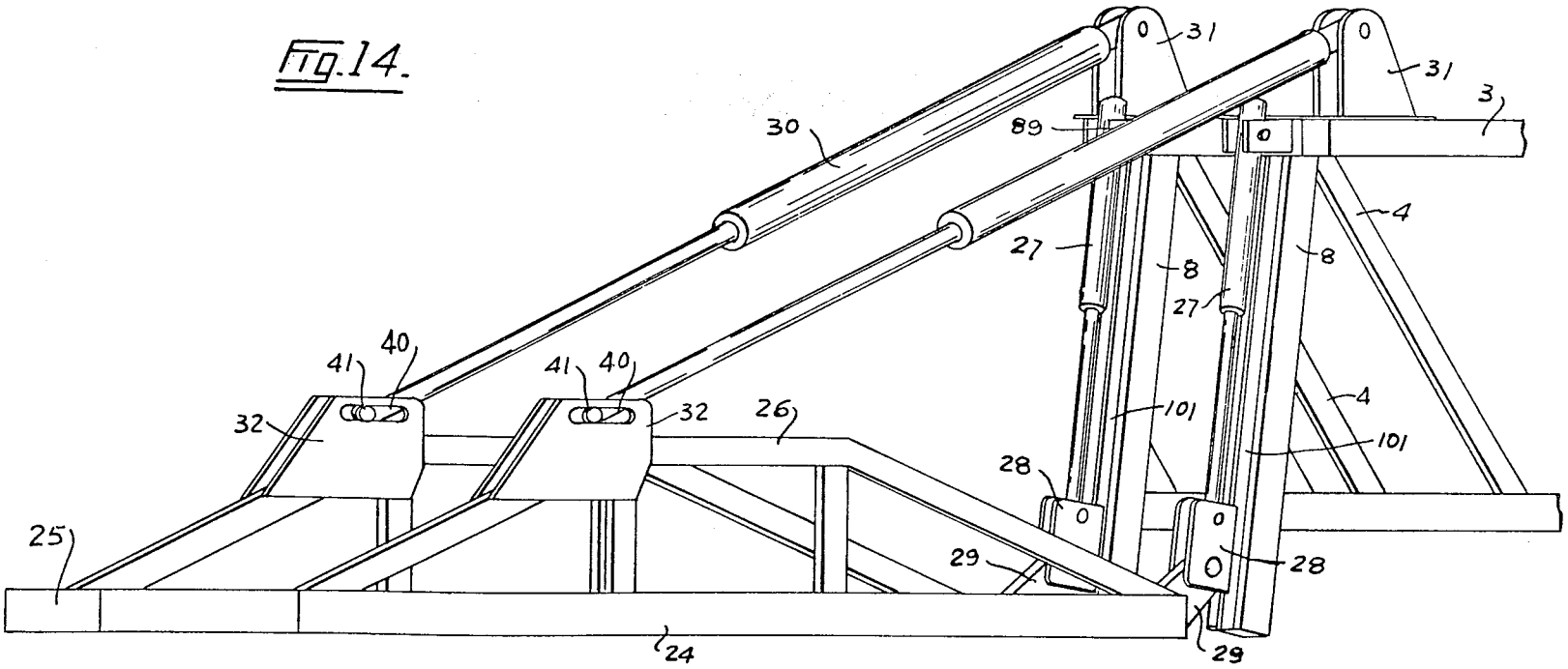
FIG. 14 is a perspective view of the hoisting-tilting assembly.

This system is illustrated to FIG. 11. First and second transverse members 9 are part of the main frame 1. First and second sleeve members 11 are rigidly secured at the front and rear ends of the spaced, parallel, longitudinally extending track frames 90. The transverse members 9 extend into the sleeves 11 and can slide therein. A first pair of outwardly extending hydraulic cylinders 44 are each connected at their inner ends to the first transverse member at about its mid-point. At their outer ends, the first hydraulic cylinders are each connected to one of the track frames above its longitudinal centre line. A second pair of outwardly extending hydraulic cylinders 44 at each connected at their inner ends to the second transverse member at about its mid-point. At their outer ends, each second hydraulic cylinder is connected to one of the track frames below its longitudinal centre line. Means for independently actuating each hydraulic cylinder are provided, as described in the following discussion of the hydraulic systems incorporated into the ditcher.

Figure 2:
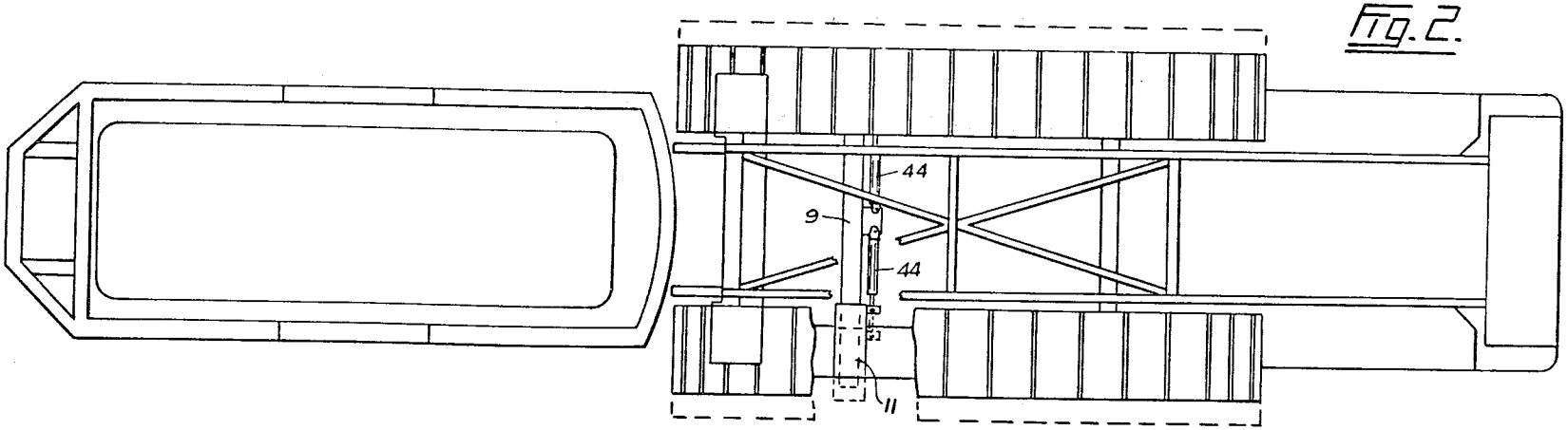
FIG. 2 is a top plan view of the carrier, with parts removed to show the detail of part of the track adjusting system.

The track width adjust system used on this ditcher contains innovations which permit the mechanism to operate in a satisfactory manner. Firstly, referring to FIGS. 1 and 2, it is seen that there is an appreciable distance "L" between the front and rear cylinder centre lines. Secondly, referring to FIG. 3, it is seen that there is an appreciable angle between the centre lines of the front and rear cylinders when viewed from the front. Thirdly, by means of the control valves in valve block 43, the operator is able to control each cylinder 44 individually and separately.

If there was only one control valve provided for the pair of front and rear cylinders 44 on each side, or one control valve for all four cylinders 44, the system would not work. This is because the forces resisting the action of each cylinder 44 are unequal due to varying friction between the sleeves 11 and transverse members 9, and unequal distribution of the ditcher weight among the sliding members. These unequal forces would enable the cylinder pushing against the least resistance to extend to the point at which the sleeves 11 were so misaligned on the transverse member 9 as to bind and resist further motion. At this point, the operator would be unable to complete the track adjustment. It is impossible to control these friction forces to obtain equal movement of both front and rear cylinders. Therefore it is desirable to provide a separate control valve for each cylinder 44 — the skewing and jamming tendencies of the sleeves 11 require individually controllable forces (provided by cylinders 44) to overcome them, although it would be possible to operate the system with one valve controlling the pair of cylinders either above or below the track frame centerline.

Figure 3:
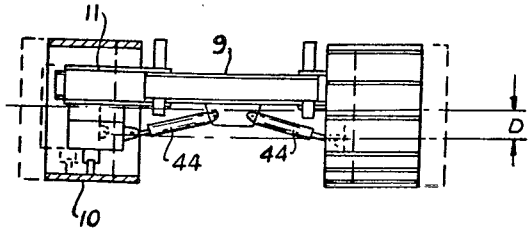
FIG. 3 is a front view showing a portion of the carrier with the track adjusting system in place — the phantom lines show the adjustment capability of the track system.

The angle between the centerlines of the front and rear cylinders 44 accomplishes two things. Firstly, the downward slops of the front cylinders establishes a vertical force component which removes a part of the vertical supporting force from, and thereby reduces friction between, sleeves 11 and transverse members 9. This reduces the lateral force required to move the track assemblies outward. Secondly, a separation in a vertical plane, denoted "D" in FIG. 3, is created between the points of force application of the front and rear cylinders. This enables a couple to be created in a vertical plane by the alternate application of hydraulic pressure to the front and rear cylinders 44 in order to reduce friction forces on the horizontal mating surfaces of sleeves 11 and transverse members 9. Similarly, the longitudinal separation of the cylinders enables a couple to be created in a horizontal plane, which is effective to reducing the friction force on the vertical mating surfaces of sleeves 9 and transverse member 11.

Hydraulic System

The hydraulic system of the ditcher comprises three main sub-systems:

A. Rear engine-driven duplex pump system.
B. Rear engine-driven pump-motor system.
C. Front engine-driven pump-motor system.

A. Rear Engine-Driven Duplex Pump System

The duplex pump 22 powers all mechanisms on the ditching machine which are actuated by hydraulic cylinders and are not in continuous motion when the ditcher is in operation. The duplex pump 22 also supplies pressure to the crawler brakes 49 and hoist 79. The duplex pump 22 is driven from the front crankshaft system of engine 13.

1. Forward, Smaller Section of Duplex Pump 22

The operator, from within the operator compartment 42, and by manipulating four separate valves in valve block 43 (one for each cylinder 44) can actuate individually and independently each track adjusting cylinder 44 and can shift the tracks inwardly or outwardly from the centerline of the ditcher by using the front track adjusting cylinders and rear track adjusting cylinders alternately or together. To be able to move the tracks inwardly or outwardly at all, the operator should be able to "wiggle" them by operating each front and rear cylinder 44 individually.

Flow divider 45 is supplied with high pressure hydraulic fluid from the forward section of pump 22 through valve block 43. The flow divider is adjustable by the operator to supply high pressure hydraulc fluid either to valve block 48 or to hoist 79, but not to both at once. Hoist 79 is normally used when the ditcher is stationary to assist in the installation or removal of buckets (FIG. 1), the raising of the conveyor extensions, and any work, to which the hoist can reach, which requires a heavy lifting capability.

The operator, by means of a control valve in valve block 48 can select the low, digging ground speeds, the faster, transport ground speed or neutral by activating the hydraulic cylinders 46 which move shift forks within the travel gear boxes 47 to select the appropriate gear or neutral.

The operator, by means of a control valve in valve block 48 can apply pressure to the brake units 49 embodied in each crawler final drive housing, and also release said pressure. Another valve 50 is provided to hold pressure in the brake pressure apply lines and thereby to maintain the brakes in the applied condition and so prevent the machine from moving if it is stationed on a surface such as a hill on which it would move without the use of its own power.

Valve block 43, and (through flow divider 45) valve block 48 and hoist 79 are supplied with hydraulic fluid under pressure from the forward smaller section of duplex pump 22, which draws fluid from the hydraulic reservoir tank 23 through the fluid supply line 51 and filter P3. Exhaust hydraulic fluid from the valve blocks 43 and 48 returns to the reservoir through two lines 67, filter F8 and main fluid return line 52. It is not an imperative feature that the four valves which independently operate the crawler trackwidth adjust system be mounted together in the same valve block 43. They can each be separate, in pairs, etc. The shift control valve and brake control valve which comprise valve block 48 can be separate instead of being contained within the same valve block.

2. Rearward, Larger Section of Duplex Pump 22

The rearward, larger section of the duplex pump 22 draws hydraulic fluid from the same supply line as the forward, smaller section of the same pump, and supplies fluid under pressure to valve block 53. The operator may, by operating a valve in valve block 53, extend or retract the upper cylinders 30, which operate equally and in parallel as described in previous sections. The length to which the two upper cylinders 30 are extended at any moment in time is maintained equally the same by the use of a flow divider 54 which maintains equal fluid flow to and from each cylinder 30.

Figure 8:
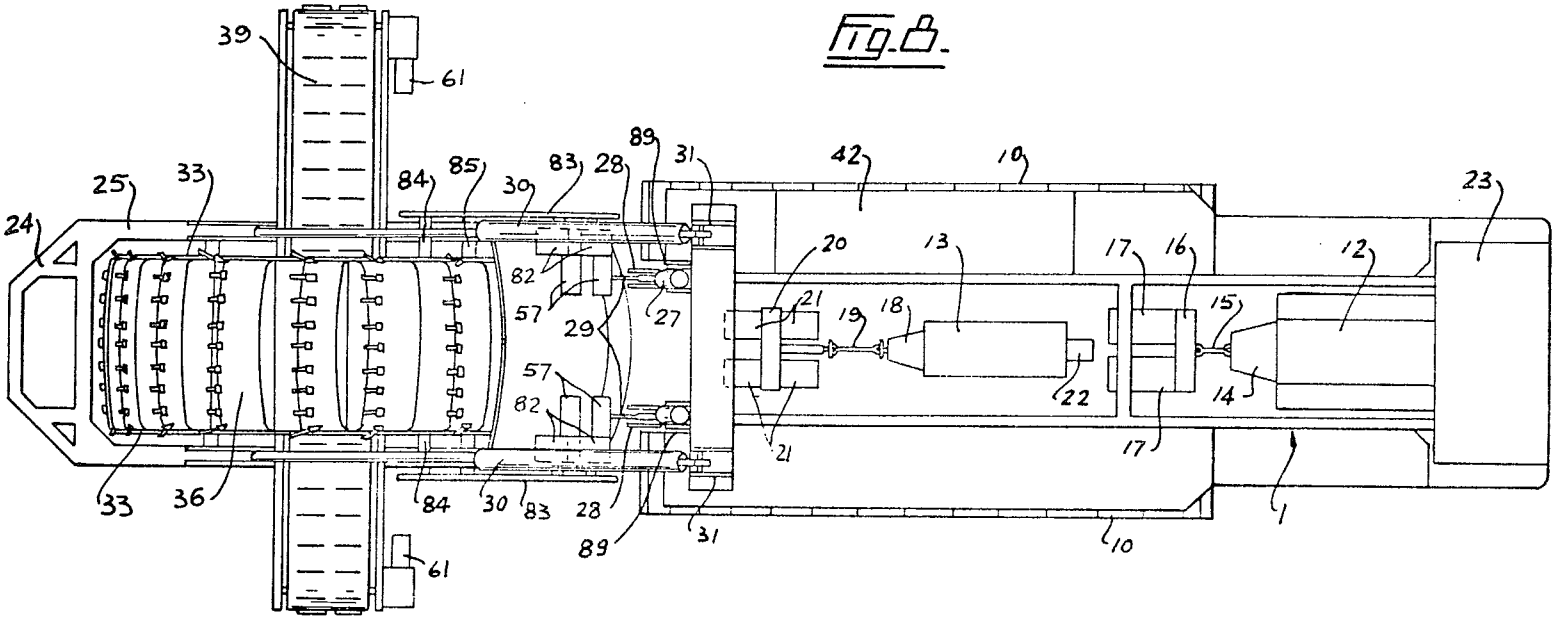
FIG. 8 is a top plan view of the ditcher.
Figure 9:
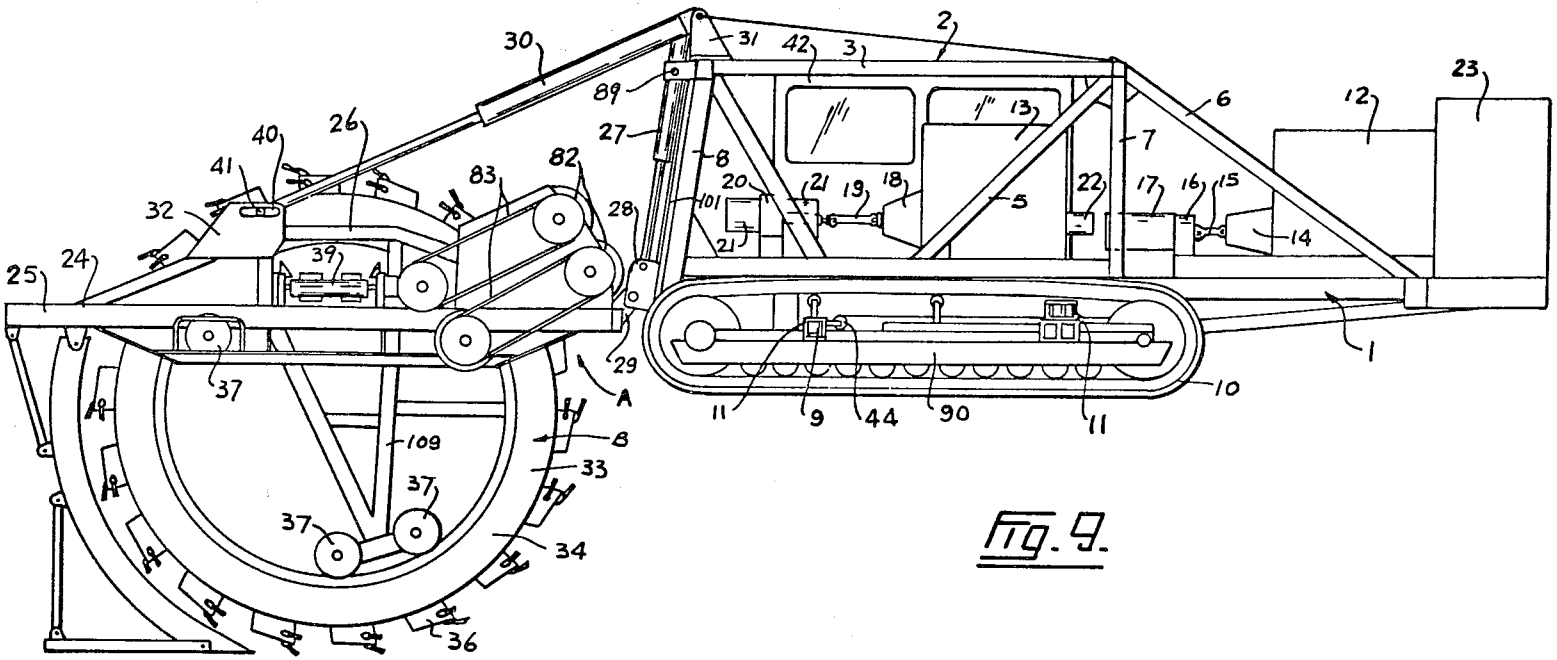
FIG. 9 is a side elevation of the ditcher.
Figure 10:
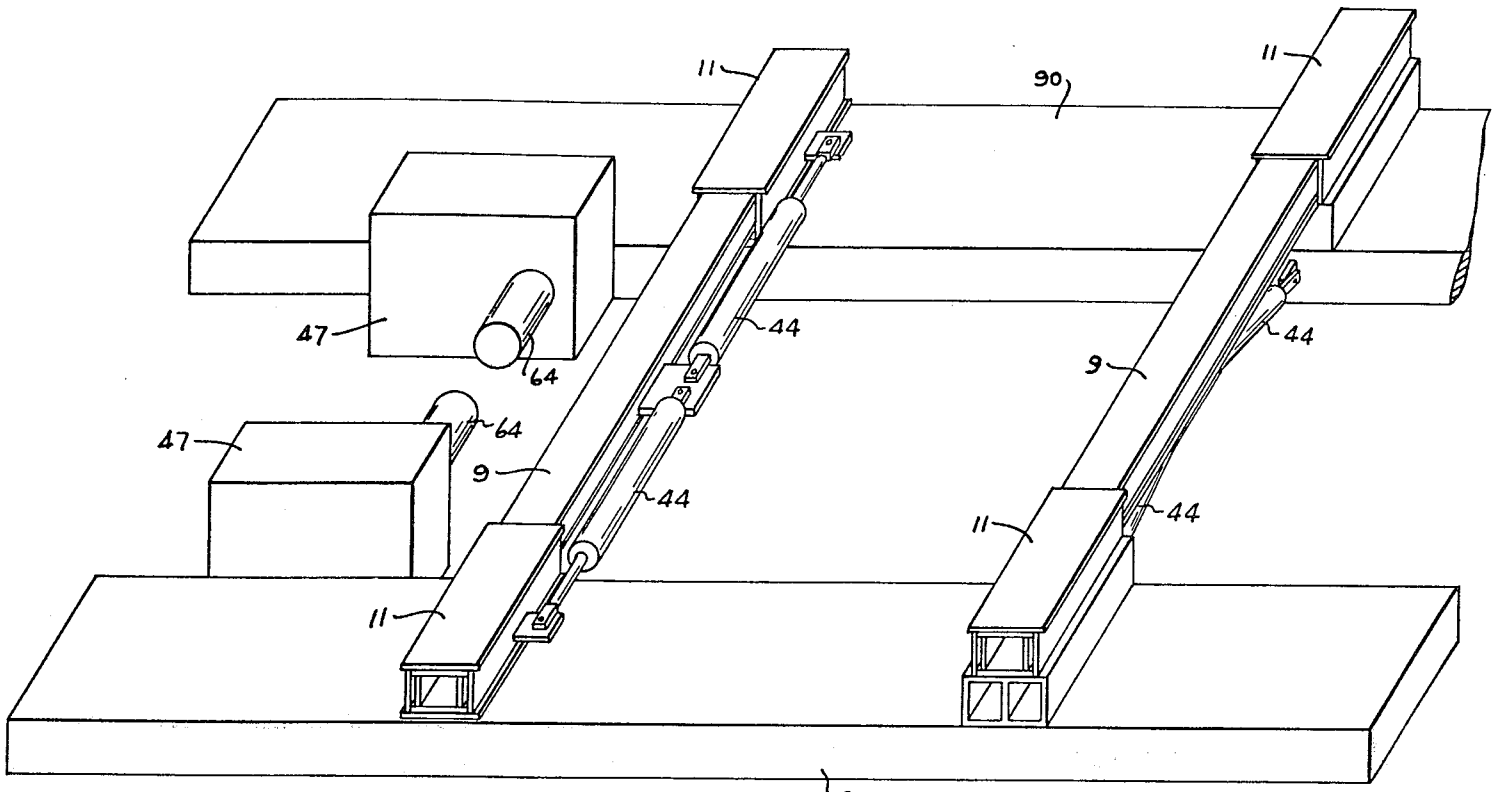
FIG. 10 is a perspective view showing the track-spreading system.
Figure 12:
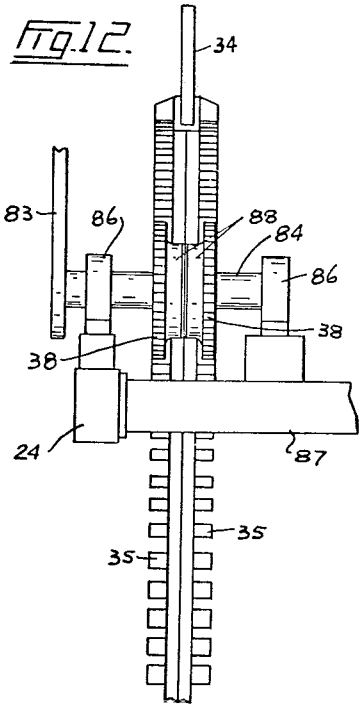
FIG. 12 is an end view, with parts broken away, showing the double segment drive for the wheel and the drive sprockets.

There is the possibility that the operator may at some time wish to apply individual and separate control to each hydraulic cylinder 30, for example if he wishes to apply more downward force to one side of the digging wheel than the other to compensate for irregularities in the material being trenched. This capability would be useful with respect to digging wheels wider than that used on the invention at the present time. The individual control of each cylinder 30 is accomplished by removing flow divider 54 and installing lines 80, shown dashed in FIG. 8, to connect the spare control valve which exists in valve block 53 with one cylinder 30. The other cylinder 30 is then actuated by the control valve in valve block 53 which is shown in FIG. 8 as supplying flow divider 54.

Valve block 53 also incorporates two valves, one for each cylinder 27, by means of which the operator may extend or retract the two slide cylinders 27 independently and individually, or together. The independent operation of the two slide cylinders 27 enables the operator to adjust the tilt of the digging wheel for digging on side hills, in which case one cylinder 27 is extended more than the other cylinder 27 to create the desired angle, as shown in FIG. 5.

The valves incorporated together in valve block 53 can each be mounted separately or in pairs without effecting the operation of the hydraulic cylinders 27 and 30. Exhaust fluid from the hydraulic systems controlled by valve block 53 is returned to the reservoir 23 through line 68, filter F8 and main fluid return line 52.

In the event that any part of the hydraulic circuits supplying hydraulic fluid to cylinders 27 and 30 should fall causing fluid to escape from the system to the atmosphere, automatic check valves 55 on each cylinder 27 and 30 prevent displacement of the hydraulic fluid within the cylinders 27 and 30 and therefore prevent movement of the pistons in the cylinders. This is an important safety feature as it prevents the digging wheel assembly from falling downwardly from the raised position and causing possible injury to workers.

It is not necessary to operate front engine 12 and pumps 17 to perform any of the functions described in section A above, except as noted under "Cross-Over System" below.

B. Rear Engine - Driven Pump Motor System

The rear engine 11 as previously described drives four variable-displacement pumps 21 by mechanical means. The pump-motor systems described below are of hydrostatic type.

1. Conveyor Drive Pump-Motor System

The forward pair of variable-displacement pumps 21 is connected each one to a fixed-displacement hydraulic motor 61 by pressure lines 69. The hydraulic motors 61 drive the conveyor mechanism which removes excavated material from the machine and deposits it on unexcavated terrain. By adjusting the swashplate mechanism of the forward pair of pumps 21 remotely from within the compartment 42, the operator can adjust the speed of the conveyor mechanism to match the amount of material being excavated and he can also, by means of the same control, reverse the sense of rotation of the motors 61 to permit the conveyor system to discharge the excavated material to either the left hand side or the right hand side of the trench. By adjusting the swashplate mechanism of the forward pair of pumps 21 to the neutral position so that no pumping takes place the operator can stop the conveyor mechanism when it is not required — for example when the ditcher is moving under its own power to or from a work site and no ditching is being performed. The conveyor system would otherwise operate since the front pair of pumps 21 must rotate when the crawler mechanism is operating due to the continuous mechanical connections between the pumps in gear box 20.

When the ditcher is being transported by means other than its own, it is common to separate the forward crawler portion of the ditcher from the rearward digging wheel and its associated frame and mechanism to enable the two portions to be transported separately. Since the pumps 21 are on the forward crawler portion of the ditcher and the motors 61 are on the rearward digging wheel assembly, the hydraulic lines 69 and 70 between the pumps 21 and motors 61 can be separated by means of couplers 62 without loss of hydraulic fluid.

The hydraulic lines from the forward pair of pumps 21 are cross-connected between the two high pressure lines and cross-connected between the two low-pressure lines, this cross-connection being effected by hoses 71 located just in front of couplers 62. The duplication of pumps and circuits is a fail-safe feature so that it one pump should malfunction, the other is able to drive the conveyor system at reduced speed and trenching can proceed at a slower rate. This back-up capability is of great importance from a standpoint of reliability in view of the difficult digging conditions likely to be encountered in the Arctic and also in view of the maintenance and supply difficulties associated with the Arctic, and which becomes critical with wintertime operation.

It is necessary to be able to move the forward crawler portion of the trencher by means of its own power, separate from the digging wheel assembly, when it is being manoeuvered for transportation to or from work sites. To accomplish this, the rear engine 13 must be running in order that the rear pair of pumps 21 operate the crawler mechanism. However, the forward pair of pumps 21 must also operate if the rear pair of pumps are operating because of the continuous mechanical connection between the pumps in gear box 20. the conveyor pump-motor circuits are incomplete since the hoses 69 and 70 have been separated at couplers 62 in order to remove the digging wheel assembly. This means that the front pair of pumps 21 would pump into lines which are closed and sealed at the couplers 62. In this instance, extremely rapid pressure rise would cause failure through hydraulic lock in the front pumps 21 or the hoses connected to them. To eliminate this possibility, automatic flow control valves 63, which are normally closed, open in order to complete the circuit and permit the front pair of pumps 21 to rotate normally. It is noted that it would be possible to operate the crawler mechanism with rear engine 13 running, and without the automatic flow control valves 63, by placing the swashplate mechanisms of the forward pair of pumps 21 (conveyor drive) in the exact neutral position so that no pumping occurred in these pumps. The automatic flow control valves 63 are a safety feature which ensures that no damage will occur if the operator's swashplate control levers for the front pair of pumps are in any position other then neutral.

2. Track-Laying (Crawler Drive) Pump-Motor System

The right-rear variable-displacement pump 21 drives a fixed-displacement motor 64 which in turn drives, through the travel gear box 47, the track-laying (crawler) mechanism on the right-hand side of the ditcher, and thereby propels the ditcher along the ground. The left-rear variable-displacement pump 21 drives a fixed-displacement motor 64 which in the same manner drives the track-laying mechanism on the left-hand side of the ditcher. The operator is able to steer the ditcher by independently controlling the swashplate mechanism of each rear pump 21 and thereby speed up or slow down the track mechanism on one side relative to the other. The operator is also able to adjust the ground speed of the ditcher and to cause the ditcher to move in either a forward or a rearward direction by operating the swashplate mechanism of the two rear pumps 21 in unison. He can also steer and adjust the speed of the ditcher by a combination of the above-mentioned adjustments, and he can also operate the ditching mechanisms with the ditcher stationary, for example when beginning a trench, by adjusting the swashplate mechanisms of the two rear pumps 21 to neutral.

Common Features of the Conveyor Drive and Track-Laying Pump-Motor Systems

Hydraulic fluid is provided from the main fluid supply line 51, through filters F4, F5, F6, and F7 to small charge pumps "C" on the ends of, and integral with all four pumps 21 to make up for leakage in the conveyor drive and track-laying (crawler drive) pump-motor systems. Leakage flow from the motors 61 and 64 is returned to pump cases 21 by means of free-flow (non-pressurized) lines 70 and 72, and from the pumps 21 to the reservoir 23 through lines 73, filter F8 and the main fluid return line 52.

All four pumps 21 incorporate pressure relief valves to protect the hydraulic components from high pressures which would otherwise occur due to possible overloading of the conveyor or track-drive mechanisms.

The swashplate mechanisms which enable the operator to vary the speed of the conveyor drive and crawler drive mechanisms also permit him to adjust the speed of engine 13 to any desired value up to maximum to obtain the best engine efficiency or power for the particular operating conditions. The engine is then maintained at that speed by its governor control. The adjustment of the swashplate mechanisms does not in itself change the rotational speed of engine 13.

It is not necessary to operate front engine 12 and pumps 17 to perform any of the functions described in section B above, except as noted in "Cross-Over System" below.

C. Front Engine-Driven Pump-Motor System

The front engine 12 as previously described drives two variable-displacement hydraulic pumps 17 by mechanical means. The flow from the two pumps 17 is delivered to a common manifold 56 by separate lines 73 and thence by separate lines 74 from the manifold 56 to the fixed-displacement digging wheel drive motors 57. The manifold ensures a supply of hydraulic fluid of equal flow and equal pressure to each hydraulic motor 57, to equalize the load carried by each motor. Each motor 57 drives independently through a gear box to a chain which turns the digging wheel 33 (FIG. 1) through the sprocket-segment gearing system. The four motors 57 are arranged two to each side of the digging wheel. The return flow of hydraulic fluid from motors 57 is through separate lines 75 to manifold 58 and is returned to the low pressure side of the two pumps 17 by hoses 76. All hoses 75 and 76 between the manifolds 56 and 58 and the hydraulic motors 57, and free flow return lines 77, can be disconnected at motors 57 by means of couplers 66 without loss of hydraulic fluid. This facilitates the removal of the rearward digging wheel portion of the ditcher from the forward crawler portion for transport purposes. This pump-motor system is of hydrostatic type.

The duplication of pumps 17 and circuits is a fail-safe feature in that if one pump should fail, the other is able to drive the digging wheel at reduced speed and trenching can proceed at a slower rate. Trenching is also possible should one or two of the hydraulic motors 57 and/or their associated circuits and drive mechanisms malfunction. This back-up capability is of great importance from a reliability standpoint as previously discussed in section B.

Pressures which exceed the normal working pressures of this pump-motor system may be caused, for example; when the digging wheel hits something extremely hard, causing the motors 57 to slow down or even stall momentarily. To allow for this, and for any malfunction which could cause pressures to exist which exceed the operating limits of the circuit, pressure relief valves 59 and one-way check valves 60 are provided to divert the flow from pumps 17 in the direction from manifold 56 to manifold 58 or vice-versa and thence back to the pumps. These valves are in addition to pressure relief valves which are incorporated in pumps 17. Pressure relief valves 59 are manually adjustable to enable the maximum operating hydraulic pressure of the digging wheel drive pump-motor circuits to be varied over wide limits. This feature is useful at initial start-up, for example, when the pressure relief setting is adjusted to a low value to enable the operation of the hydraulic pumps, motors, and digging wheel drive system to be checked with the least risk of damage due to faulty hydraulic connections, etc. The operator may, by adjusting the relief valves, vary the maximum power developed by the motors 57 to suit any digging requirements.

Fluid is provided from the main fluid supply line 51 through filters F1 and F2 to small charge pumps "C" on the ends of, and integral with, pumps 17 to make up for leakage in the system. Leakage flow from the motors 57 is returned to the pumps 17 by means of free-flow lines 77, and from the pumps 17 to the reservoir 23 through lines 78, filters F9 and F10 and the main fluid return line 52.

It is desirable to be able to adjust the rotational speed of the digging wheel 33 in fine increments without adjusting the rotational speed of the front engine 12. This is to enable front engine 12 to operate at a pre-set optimum speed to obtain the best engine efficiency and/or power for a particular operating condition. The engine is then maintained at that speed by its governor control. The adjustment of the digging wheel speed is accomplished by means of swashplate mechanisms incorporated in the pumps 17 and which are remotely adjustable by the operator from within the compartment 42 to provide a digging wheel speed infinitely variable between 0 and maximum. The swashplate mechanisms vary the displacement of the pumps 17 and therefore the amount of hydraulic fluid delivered to the motors 57, thus directly varying the speed of the motors 57. The operator is able to adjust the swashplate mechanism of the pumps 17 individually as well as in unison, and therefore obtain very fine control of digging wheel speed. By means of the swashplate mechanism the operator is also able to reverse the flow of fluid to the motors 57 and thereby reverse the rotation of the digging wheel if necessary. The adjustment of the swashplate mechanisms does not in itself change the rotational speed of engine 12.

The functions performed by the hydraulic circuits described in section C above are not dependent on rear engine 13 and pumps 21. Motors 12 and 13 power separate and different portions of the ditcher's machinery, except as described in "Cross-Over System" below, and as such increase the reliability of the equipment.

Cross-Over System

The basic feature of having two separate engines to drive the ditcher is utilized so that the front engine 12, in an emergency, can take over some of the functions of the rear engine 13. In the event that there occurs some malfunction in the rear engine 13, pump drive components 18, 19, 20, any of the pumps 21, or pump 22, it must still be possible to lift the digging wheel out of the trench and more the machine under its own power off of pipeline right-of-way to a location where it can be repaired. This is extremely important in that a stalled ditcher would halt the entire pipeline operation behind it, a situation which is undesirable from the standpoints of cost and time. It is mandatory in such a situation that the stalled ditcher be moved quickly away from the right-of-way and another trencher take its place.

It is an object of the invention to incorporate a cross-over system that would enable the front engine 12, through pumps 17, to power the crack-laying (crawler drive) motors 64 and the various hydraulic cylinders 27, 30, 44, 46, and the crawler brakes 49 — all these devices being normally powered by rear engine 13 through the rear pair of pumps 21 and duplex pump 22. The cross-over system is shown in FIG. 8 in dashed lines.

To effect the cross-over, flow dividers 65 are operated to divert the flow in lines 73 and 76 from the motors 57 to the cross-over circuit. To effect the cross-over, it is also necessary to open the two valves 81, which are normally closed to prevent cross-connection between the different hydraulic systems. It is necessary to isolate manifolds 56 and 58 from pumps 17 by means of the flow dividers 65 since the output from each of the two pumps 17 must be independently adjustable by means of the swashplate mechanisms in order to steer the ditcher (see description in section B, above, of crawler pump-motor system). With the cross-over system shown in FIG. 8 it is possible to operate all hydraulic devices on the ditcher except the conveyor drive motors 61 and the digging wheel drive motors 57.

It is noted that the plurality of hydraulic pumps used on the invention is of great advantage because, in the event of a failure in part of some hydraulic circuit, any one of these pumps may be coupled relatively conveniently, by means of flexible hoses and standardized fittings, to power a hydraulic device which is, in the normal operation of the machine, powered by some other hydraulic pump. This versatility of power application and connection contributes to the overall reliability of the machine. Therefore, many cross-over hydraulic supply systems are possible, in addition to the one described above and shown in FIG. 8. For example, in the event of a malfunction in the crawler drive pumps, conveyor drive pumps, or both, one or two pairs of lines 74 and 75 may be disconnected from motors 57 to power the malfunctioning circuits. Output from pump 22 can also be diverted for the same purpose. In these instances, separate control valves and circuits for the left-hand and right-hand crawler brakes would be required for steering purposes.

Twin Double Segment Drive

As shown in FIGS. 7, 12, 13 and 14, the non-axially supported digging wheel assembly 33, incorporating the spaced rim assemblies 34, the double segment teeth assemblies 35, and buckets 36 is driven by engine 12 through a hydraulic-mechanical system.

Engine 12 drives hydraulic pumps 17 which in turn supply high-pressure hydraulic fluid to four hydraulic motors 57 mounted two on each side of the wheel frame 25. The motors 57 each drive a reduction gear box 82 which in turn drives through chains 83 to the two shafts 84 and shaft 85, supported by bearings 86. A double sprocket 38 is rigidly attached to each shaft 84 and to each of the ends of common shaft 85. Each rim assembly 33 carries a row or segment 35 of spaced teeth projecting from its inner and outer faces adjacent its circumference. The double rows of teeth of each sprocket 38 engage the teeth of the segments 35 of the adjacent rim assembly 33 and function to drive it. The land 88, located between the spaced rows of teeth of each double sprocket 38, bears against the smooth inner surface of the rim assembly 33, in similar fashion to rollers 37, and helps to locate and support the digging wheel, as well as relieving the gear teeth from stresses resulting from bearing the weight of the wheel.

Shaft 85 is driven by two motors 57 and is supported by two bearings 86 mounted directly on wheel frame assembly 24. The two shafts 84, driven by one motor 57 each, are supported at their outboard ends by two bearings 86 mounted directly to frame assembly 24, and at their inner ends by two bearings 86 mounted on support member 87 which is attached to wheel frame assembly 24.

The shaft 85 drives to both rims 34 of wheel assembly 33 and therefore prevents any relative rotation of the two rims which might occur if the drive systems to the two sides were totally separate. Such relative rotation would impart a twisting stress to the buckets connecting the two rims; such stress cannot occur in this design.

Whereas the usual trencher designs employ one row of segments per rim, this invention employs two rows per rim (FIGS. 13, 14); and, instead of one sprocket per row of segments, this invention employs two sprockets per row of segments. Therefore, each segment row of this design transmits only half the power transmitted by one row in previous designs; each sprocket transmits only 1/4 the power transmitted by one sprocket in previous designs. This load-sharing, brought about by a multiplicity of segment rows and sprockets, contributes greatly to the overall reliability which is an objective of this design.

What is claimed is:

1. In a ditcher comprising a wheel frame having a non-axially supported digging wheel rotatably mounted thereon, said wheel having a pair of spaced rim assemblies, each said rim assembly having inwardly and outwardly directed side faces, the improvement which comprises:

a row of spaced teeth projecting from each of said side faces adjacent the circumference of said rim assembly to provide a double segment tooth assembly for accepting torque input from a drive sprocket;

at least two double drive sprockets rotatably mounted on the wheel frame adjacent each rim assembly and engaging said rows of teeth to drive the wheel; and means for rotating the drive sprockets.

2. The improvement as set forth in claim 1 wherein:

each drive sprocket has a land between its rows of drive teeth, which land functions as a bearing to help support the digging wheel.

3. The improvement as set forth in claim 1 wherein:

a common shaft connects a drive sprocket associated with each rim assembly, thereby interconnecting said rim assemblies.

4. In a ditcher comprising a wheel frame including a digging wheel, having spaced rim assemblies, and being rotatably mounted in the wheel frame, the improvement which comprises:

double segment teeth assemblies mounted on each rim assembly;

twin double sprockets mounted on the wheel frame and engaging each double segment teeth assembly; and means for powering the sprockets.

* * * * *